US006070596A

United States Patent [19]

Altamore

[11] Patent Number: 6,070,596

[45] Date of Patent: Jun. 6, 2000

[54] HEATED HAIR STYLING DEVICE

[75] Inventor: Nicolo Altamore, Rockford, Ill.

[73] Assignee: Wahl Clipper Corporation, Sterling, Ill.

[21] Appl. No.: 09/345,557

[22] Filed: Jun. 30, 1999

Related U.S. Application Data

[63] Continuation-in-part of application No. 09/160,688, Sep. 25, 1998, abandoned.

[51] Int. Cl.[7] ..... A45D 1/00; A45D 2/40

[52] U.S. Cl. ..... 132/224; 132/225; 132/229; 219/222; 219/225

[58] Field of Search ..... 132/224, 225, 132/227, 229, 118, 223, 232, 271; 219/222, 225, 226, 227, 228, 229, 230, 231

[56] References Cited

U.S. PATENT DOCUMENTS

| | | | |
|---|---|---|---|
| D. 384,439 | 9/1997 | Howard | D28/35 |
| D. 389,953 | 1/1998 | Seifert | D28/35 |
| 959,867 | 5/1910 | Keefe | 132/224 |
| 1,105,962 | 8/1914 | Carlson . | |
| 1,376,416 | 5/1921 | Forshee . | |
| 1,473,312 | 11/1923 | Passard | 132/224 |
| 2,192,890 | 3/1940 | Boda | 219/24 |
| 2,598,330 | 5/1952 | Wilson | 132/14 |
| 2,988,091 | 6/1961 | Long | 132/31 |
| 3,516,420 | 6/1970 | Porter | 132/7 |
| 3,731,694 | 5/1973 | Moro | 132/118 |
| 3,935,423 | 1/1976 | Pucci | 219/225 |
| 4,163,143 | 7/1979 | Federico et al. | 219/225 |
| 4,257,434 | 3/1981 | Wahl | 132/33 R |
| 4,368,376 | 1/1983 | Andis | 219/222 |
| 4,473,086 | 9/1984 | Thaler et al. | 219/222 |
| 4,561,455 | 12/1985 | Pajak | 132/37 R |
| 4,567,904 | 2/1986 | Pitcher et al. | 132/33 R |
| 4,866,248 | 9/1989 | Altamore | 219/225 |
| 4,866,249 | 9/1989 | Howard | 219/225 |
| 5,046,516 | 9/1991 | Barradas | 132/232 |
| 5,400,809 | 3/1995 | Adams | 132/118 |
| 5,673,710 | 10/1997 | Schaefer et al. | 132/118 |
| 5,832,939 | 11/1998 | Nathe | 132/225 |
| 5,868,146 | 2/1999 | Henninger et al. | 132/232 |

FOREIGN PATENT DOCUMENTS

| | | |
|---|---|---|
| 1153804 | 6/1956 | France . |

*Primary Examiner*—Gene Mancene
*Assistant Examiner*—Pedro Philogene
*Attorney, Agent, or Firm*—Greer, Burns & Crain, Ltd.

[57] ABSTRACT

A hair styling device includes an elongated first leg having a top surface, a bottom surface, a styling end and a handle end, and an elongated second leg pivotally secured to the first leg between an open and a closed position. The second leg has a top surface, a bottom surface, a styling end and a handle end. A plurality of teeth are disposed on at least one of the top surface of the first leg and the bottom surface of the second leg. Respective styling ends of the first and second legs are configured to nest together in the closed position to define a space on the styling end configured such that hair can flow freely through the space as the device is passed through a subject's hair.

17 Claims, 4 Drawing Sheets

HEATED HAIR STYLING DEVICE

RELATED APPLICATION

This application is a Continuation In Part of U.S. Ser. No. 09/160,688, filed Sep. 25, 1998, now abandoned.

FIELD OF THE INVENTION

The present invention relates generally to heated hair styling devices similar to hair curling irons or curling brushes, and more particularly, to multi-functional hair curling/straightening devices with brushing ability having first and second legs.

BACKGROUND OF THE INVENTION

Hair curling irons and curling brushes are well known in the prior art. Most conventional curling irons utilize a smooth, elongated tubular barrel secured to a handle, with a heating element inside the tube. An unheated clamp extends along a portion of the barrel for the purpose of clamping or holding sections of hair against the round barrel. Heat that is transferred from the heating element to the barrel causes hair which is wrapped around the barrel to retain a curl after the hair is removed from the curling iron. This type of device is used primarily to create "flat" or spiral curls which mimic the effect of a roller set. However, the curls are somewhat flat and ribbon-like. Also, the clamp on the curling iron tends to crimp hair at its edges, which is an undesired look. Flat hair styling irons are also known which are used to straighten hair with no curvature. A known drawback of these devices is that only flat, pressed hair is obtained, which looks unnatural.

Heated hair curling brushes use a barrel that has elongated teeth to catch and comb the hair while the hair is being curled. Since they usually do not have a clamp, curling brushes do not produce the sharp ribbon-like curls of a curling iron, and tend to make soft curls or styles. The teeth on the barrel reduce clumping by separating the hair strands, and because of the absence of the clamp, the crimping effect of curling irons is alleviated. One drawback of a curling brush is the inability to press naturally curly hair for straightening purposes.

While conventional curling irons provide virtually complete control over the styled hair, as far as providing the stylist the desired results, curling brushes do not provide such control. In fact, the stylist has no control as to exactly how the hair will look after being styled with a curling brush.

Another conventional hair styling device is known as a crimper and is used for straightening curly hair. Crimpers include a pair of opposed, flat, heated surfaces which are pressed together with a section of hair in between to be straightened. A disadvantage of crimpers is that they provide an unnatural "pressed" look to the hair.

Thus, there is a need for a hair styling device which allows the user or stylist to selectively introduce natural-type soft curls, or to press curly hair for straightening or subsequent styling of the hair.

Accordingly, one object of the present invention is to provide a new and improved hair styling device which provides the stylist with more control over the styled hair.

Another object is to provide a new and improved hair styling device which provides the natural soft curl a curling brush provides, while also having the ability to either curl or straighten the hair as the user desires, and to provide a natural looking heat-treated hairstyle.

SUMMARY OF THE INVENTION

These and other objects are met or exceeded by the present hair styling device. An important feature of the present device is that it combines the positive aspects of both curling irons and styling brushes while avoiding their drawbacks.

In keeping with one aspect of the invention, a heated hair styling device includes two legs which are pivotally connected to each other and biased in an open position. When the two legs are moved into the closed position, a plurality of ridges define a space between the two legs. This space allows most of the hair to move freely through the space when the styling device is pulled over the hair, creating a more natural looking curl than that provided by a conventional curling iron. Specially configured ridges allow the user to apply a selective braking force on some of the hair which controls the amount of heat applied. The first leg may include a smooth bottom surface which can be rubbed over curly hair, effectively straightening it. Also, the ends of the first leg and second leg may be releasably locked together by a latching mechanism. The user or stylist may then use the device as a conventional curling brush, or to press curly hair upon a relatively smooth heated surface of the device for styling or straightening.

More specifically, the present invention provides a hair styling device which includes an elongated first leg having a top surface, a bottom surface, a styling end and a handle end, and an elongated second leg pivotally secured to the first leg between an open and a closed position. The second leg has a top surface, a bottom surface, a styling end and a handle end. A plurality of teeth are located on at least one of the top surface of the first leg and the bottom surface of the second leg. Respective styling ends of the first and second legs being configured to nest together in the closed position to define a space on the styling end such that most of the hair can flow freely through the space as the device is passed through a subject's hair.

The first leg and the second leg of the hair styling device are attached to each other at a pivot point. The second leg is nestably engaged with at least the top of the first leg, allowing the first leg and the second leg to be brought together and rotated axially as a unit. When the first leg and the second leg are brought within proximity of each other, a space is created between the first leg and the second leg, allowing most of the hair to flow freely between the first leg and the second leg in a controlled manner. To aid in the controlled flowing of the hair, teeth are provided in rows at least in the space. Additional teeth are optionally arranged on other surfaces of the device.

At least one heating element is provided in at least one of the first leg and the second leg. In the preferred embodiment, separate heating elements are provided in both the first leg and the second leg. By providing a plurality of heating elements in both the second leg and the first leg, the hair is heated more effectively and evenly.

In all, the present styling device provides the user with many different styling tools in one unit, with each providing, to varying degrees, a more natural looking curl than a conventional curling iron.

DETAILED DESCRIPTION OF THE INVENTION

Figure 1:
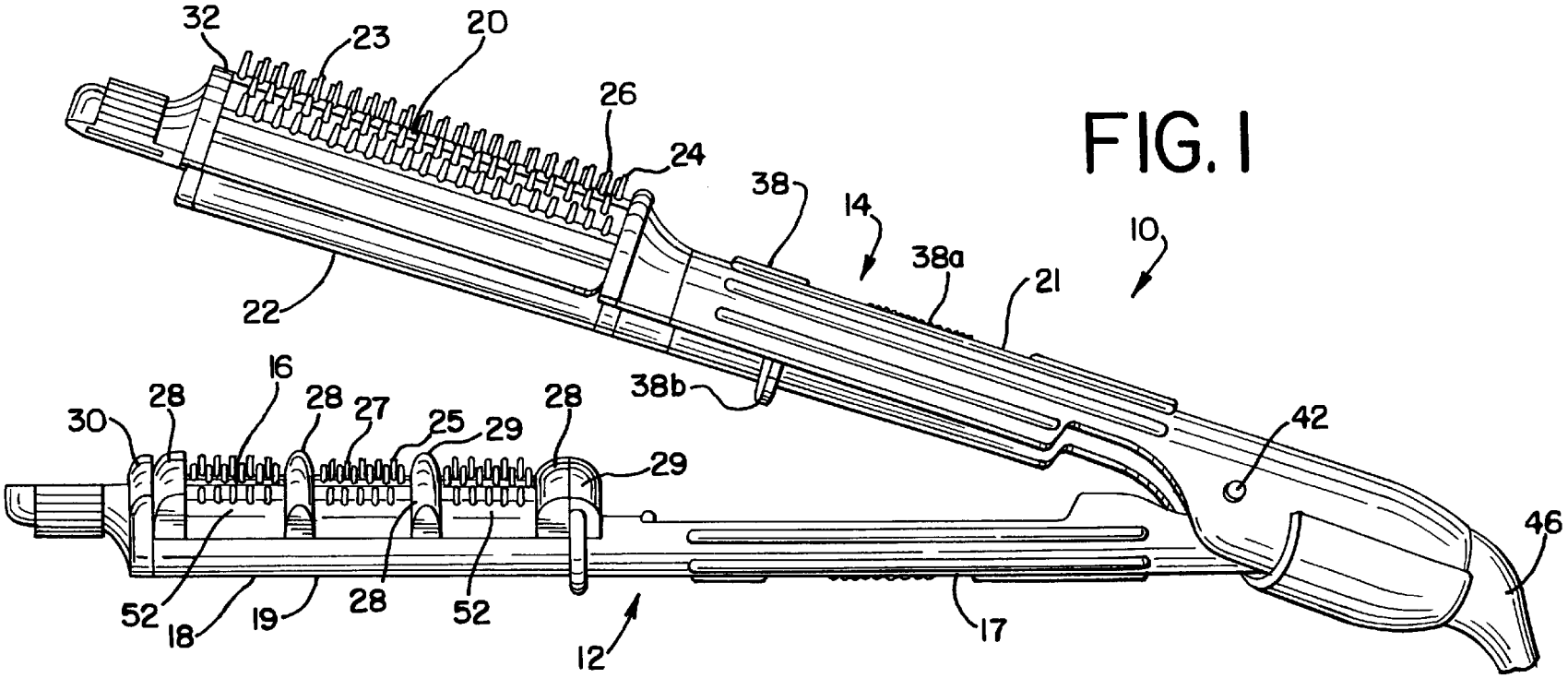
FIG. 1 is a perspective view of a hair styling device made in accordance with the principles of the invention shown in the open position.

Referring to FIG. 1, a hair styling device, generally designated 10, is shown in an open position and includes an elongated, generally tubular first leg 12 and an elongated generally tubular second leg 14. The first leg 12 has a top surface 16, a handle end 17, a bottom surface 18 and a styling end 19. The second leg 14 has a top surface 20, a handle end 21, a bottom surface 22 and a styling end 23. In the preferred embodiment, the first and second legs 12, 14 are pivotally joined to each other at the respective handle ends, 17, 21, and are movable between the open position and the closed position (best seen in FIG. 3).

On the top surface 20 of the second leg 14, a plurality of teeth 24, 26 are arranged at the styling end 23 to separate and brush the hair as it flows over the hair styling device 10. The first leg 12 has a plurality of teeth 25, 27 and a plurality of ridges 28 on the first leg top surface 16. While the ridges 28 are preferably disposed on the first leg top surface 16, it is also contemplated that the ridges 28 could also be located on the second leg bottom surface 22, or on both surfaces 16, 22. It is also preferred that the ridges 28, and the top surface 16 are made of a heat conductive material, preferably metal.

In the preferred embodiment, each of the ridges 28 has a length which spans the entire width of the top surface 16 at the styling end 19. Other lengths are contemplated depending on the application. Preferably, the ridges 28 extend radially outward from the first leg 12 by a height ranging from 0.145 inches to 0.185 inches. Also, in the preferred embodiment there are four ridges 28, each separated from the next by equal intervals. However, it is also contemplated that the number and spacing of the ridges 28 may vary to suit the application. Each of the ridges 28 has a gently rounded crown 29 to provide a braking force on strands of hair caught between the ridges 28 and the opposed leg surface without unnecessarily impeding the progress of the device 10 through the hair.

Preferably located at generally equal intervals, the ridges 28 allow the stylist to selectively increase the residence time of hair at the styling ends 19, 23, at least one of which is heated. Increased heat usually results in the hair being more responsive to styling. While defining a space 52 between adjacent ridges 28, the ridges 28 act as brakes when the user squeezes the first leg 12 against the second leg 14. Since they are dimensioned to contact the second leg bottom surface 22 when the legs 12, 14 are in the closed position, the ridges 28 press some of the strands of hair against the bottom surface 22 of the second leg 14. As the stylist moves the device 10 through the hair, grasping the legs 12, 14 together, the stylist can keep the hair taut. The combination of the ridges 28 and teeth 27 provide a more structured curl than a conventional curling brush, but also make a more natural looking curl than a conventional curling iron, thus combining the advantages of both devices, while eliminating many of their inherent problems.

An important feature of the styling device 10 is the space 52 (best seen in FIG. 3) that is created between the first leg 12 and the second leg 14 when the first and second legs 12, 14 are clasped together by the stylist, which keeps most of the hair generally flowing freely through the device 10 as it pulls the hair through it, with the exception of the hair clamped by the ridges 28. Since at least one of the styling ends 19, 23 is heated, the hair is more gently manipulated than by conventional curling irons and brushes, thus creating a more natural looking curl.

Referring again to FIG. 1, in one embodiment, the first leg 12 and the second leg 14 both respectively include a heat insulated plastic piece 30, 32 on the end of the styling ends 19, 23. The end pieces 30, 32 allow the user to grasp the end of the styling device 10 during use. The handle ends 17, 21 also do not conduct heat well, and are similar to handles found on conventional curling irons and brushes. These pieces allow the user to maintain better control over the device 10, therefore more effectively styling the hair. In conventional curling irons and brushes, the styling ends must be long with respect to the handle length to work effectively. As seen in FIG. 1, the length of the handle ends 17, 21 are roughly twice as long as the length of the styling ends 19, 23 of the first leg 12 and the second leg 14. This enhances the ability of the stylist to access and selectively style and manipulate certain portions of a subject's hair.

Another feature of the device 10 is a latching mechanism 38. This mechanism 38, preferably located on the handle end 21 of the second leg 14, includes an actuator button **38*a* and a lug 38*b* configured to interact with a counterpart receptacle 40 on the first leg handle end 17 (shown in FIG. 2), to releasably lock the first leg 12 and the second leg 14 together. With the latching mechanism 38, 40 the user may easily lock the first and second legs 12, 14 together for ease of handling when the user is only using the top surface 20 of the second leg 14 or the bottom surface 18 of the first leg 12. It is also contemplated that the lug 38*b* and the receptacle 40 may be reversed in position on the respective legs 12, 14**.

Figure 2:
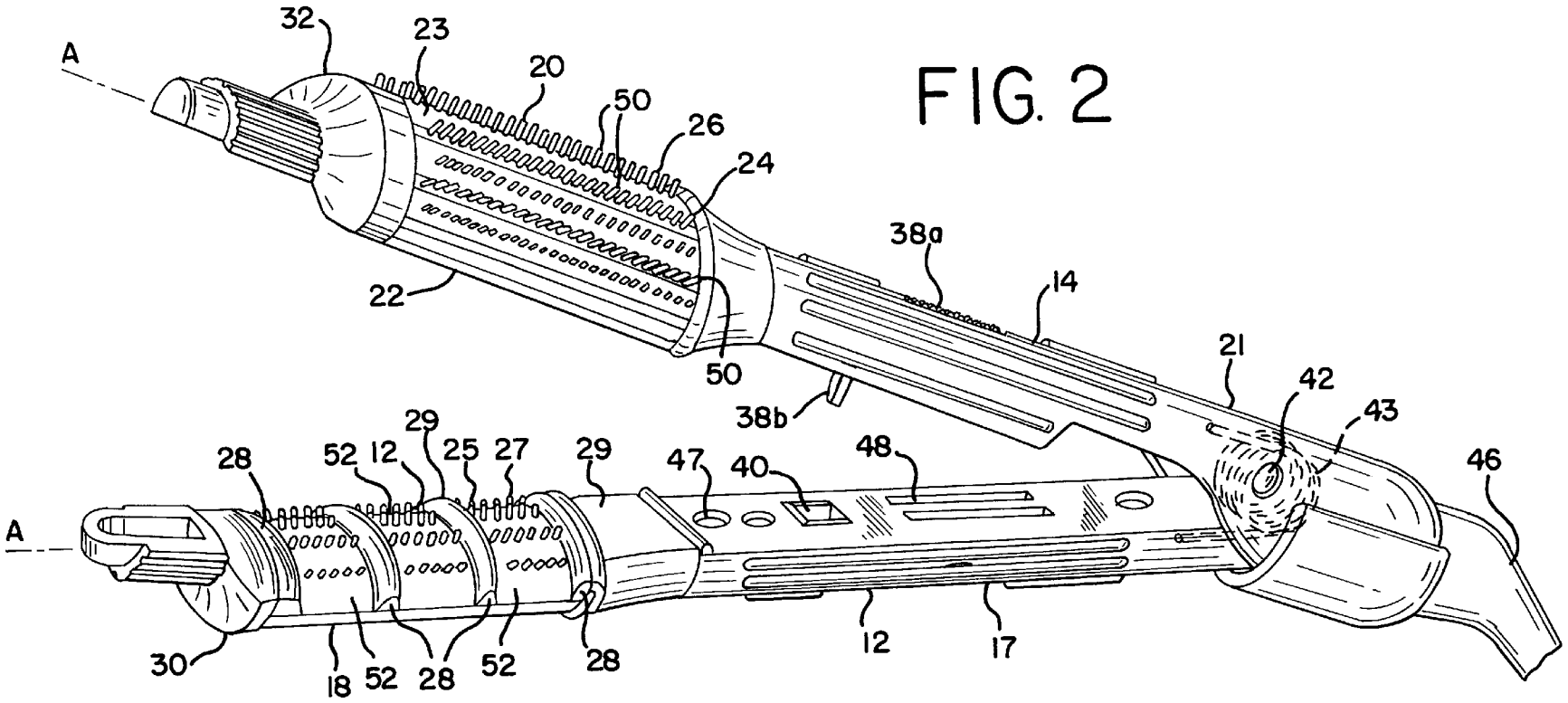
FIG. 2 is another perspective view of the hair styling device of FIG. 1, showing the top side of the first and second legs.

Referring now to FIG. 2, the second leg 14 is pivotally connected to the first leg 12 at a pivot point 42. Although the second leg 14 and the first leg 12 are connected at the handle ends 17, 21 in the preferred embodiment, it is contemplated that they could be pivotally connected at other points along the first leg 12 and the second leg 14. In the preferred embodiment, the styling device 10 is biased in an open position by use of a coil spring 43 located at the pivot point 42. Thus, the user must overcome the biasing force of the spring 43 to place the legs 12, 14 in the closed position.

The styling device 10 includes at least one heating element 44 (FIG. 3), which is energized by electrical power in the preferred embodiment. The heating element 44 is connected to an electrical swivel cord 46. Preferably, there are two heating elements 44, one in each of the first leg 12 and the second leg 14. This increases the versatility of the device 10 by providing the user or stylist with a plurality of styling surfaces. Also, multiple heating elements 44 heat the hair more effectively by surrounding the hair with heat.

The heating element 44 is turned off and on by a switch 47 which may be included on either of the handle ends 17, 21. Also included as a part of the heating element 44 is a sliding temperature control gauge 48 that regulates the temperature of the styling device 10. By being able to change temperatures, the user controls the curl of the hair better than in a conventional curling iron that is only turned on and off. A hotter temperature provides more structure to the curl, whereas a lower temperature creates a looser curl or a wave. Preferably, the temperature control gauge 48 is included on the first leg handle end 17, although other placement is contemplated.

Also shown in FIG. 2 are the teeth 24, 26 on the styling end 23 of the second leg 14. The teeth 24, 26 are arranged in a plurality of spaced rows 50 that are generally parallel to a longitudinal axis A. The teeth 24, 26 in each row 50 are arranged so that they are staggered axially from the teeth 24, 26 in the adjacent row 50. By providing staggered rows of teeth 24, 26, the styling device 10 more effectively separates the hair and creates a more natural looking curl than a conventional curling iron.

Figure 3:
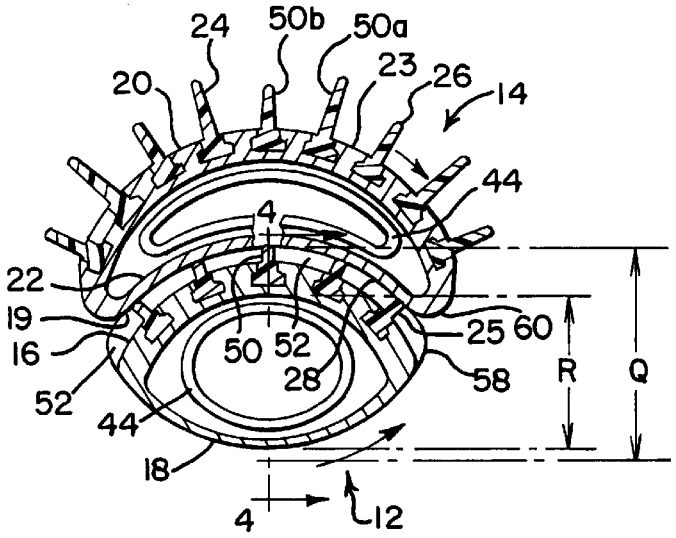
FIG. 3 is a vertical cross sectional view of the first leg and second leg of the device of FIG. 1, shown in the closed position.
Figure 4:
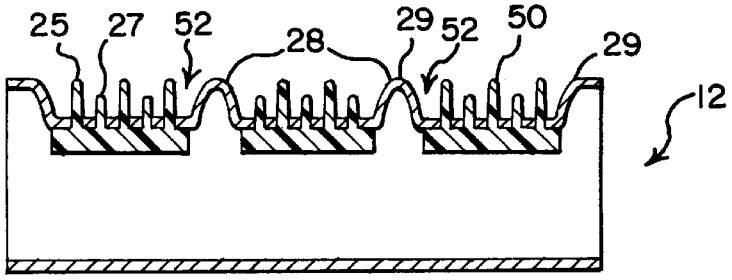
FIG. 4 is a cross sectional view taken along the line 4—4 in FIG. 3 and in the direction generally indicated.

Referring now to FIGS. 3 and 4, the teeth 24, 26 of the second leg 14 are shown in the preferred format. A plurality of teeth 24 in one row 50*a* are taller than the teeth 26 in an adjacent row 50*b*. Preferably, the taller teeth 24 are made of plastic, while the shorter teeth 26 are made of metal. By utilizing metal in the shorter teeth 26, the styling device 10 can conduct heat more effectively to the hair. However, the nonconductive plastic taller teeth 24 allow the user to wrap the styling device 10 around the hair all the way up to the hair root, without worry of burning the scalp. This is important because the hair near the scalp, or the roots, cannot be easily curled with a conventional iron because of the risk of burning the scalp. In some conventional curling brushes, the teeth are made of plastic to combat this problem. However, this does not allow the heat to travel through the teeth to the hair, and less heat transfer reduces the curling and/or straightening power of the brush. Also contemplated are rows 50 of plastic teeth 25 that alternate with shorter metal rows 50 of teeth 27 on the styling end 19 of the first leg 12 (best seen in FIG. 4).

Also shown in FIG. 4 is the arrangement of the teeth 25, 27 in the second preferred embodiment. In this embodiment, the shorter, metal teeth 27 alternate with the taller plastic teeth 25 within the same row 50. This arrangement of teeth 25, 27 may be used on the first leg 12 as well as the second leg 14, and is done for the same reason as alternating the material of the teeth 25, 27 in the first embodiment. The range in height of the teeth 25, 27 can be the same for both embodiments.

Although other dimensions are contemplated, the range of height for the shorter teeth 26 is preferably 0.140 inches to 0.210 inches. The height of the taller teeth 24 is preferably 0.230 inches to 0.270 inches. This is the same range for the taller teeth 25 on the first leg 12. Preferably, the height of the shorter teeth 27 range from 0.100 inches to 0.150 inches.

Referring again to FIG.3, it is preferable that at least the styling end 19 of the first leg 12 has an oval cross section, defining an arc which is part of a circle with radius r1, and at least the styling end 23 of the second leg 14 has a crescent-shaped cross section and is configured so that in the closed position, at least the styling end 23 of the second leg 14 nestably engages with the styling end 19 of the first leg 12. When the first leg 12 and second leg 14 are in the closed position, a generally circular cross section is created with a radius R, such that R is less than r1.

Referring now again to FIG. 4, a cross section of the first leg 12 is shown. In the preferred embodiment, the teeth 27 are made of metal for maximum heat conduction, although as discussed earlier, teeth 25 made of plastic are also contemplated. The teeth 27 of the first leg 12 are separated by the ridges 28 that are arranged generally transversely to the longitudinal axis A, thus defining the space 52 (shown in FIG. 2).

Figure 5:
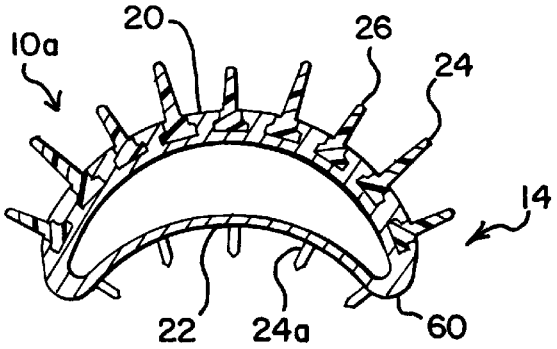
FIG. 5 is a cross sectional view of an alternate embodiment of the second leg of FIG. 1.
Figure 6:
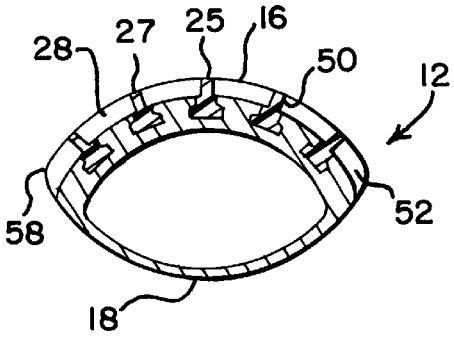
FIG. 6 is a cross sectional view of the first leg of FIG. 1.

Referring now to FIG. 5, an alternate embodiment of the device 10 is designated 10*a*, wherein like features of the device 10 are provided with identical reference numbers. In the device 10*a*, the second leg 14 includes teeth 24*a* on the bottom surface 22 as well as teeth 24, 26 on the top surface 20. This provides more brushing control when hair is captured between the first leg 12 and the second leg 14. This embodiment also contemplates both short teeth 26 and taller teeth 24 as discussed above.

Figure 7:
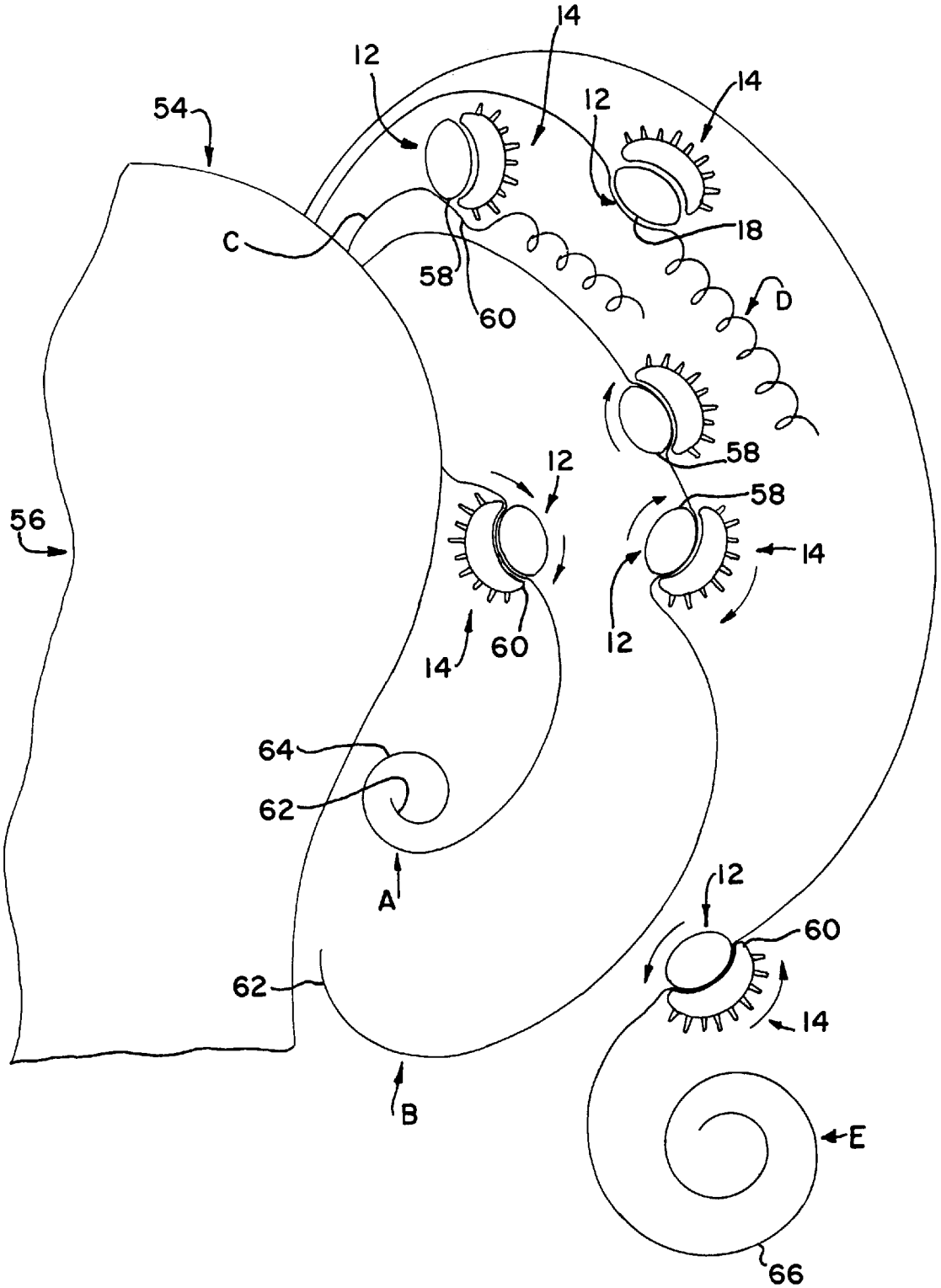
FIG. 7 is a schematic partial side view of a scalp with several strands of hair and depicting five different methods of using the present curling device to create different hair styling effects.

Turning now to FIG. 7, the various types of curls created by the present styling device 10 will be described. Due to the different shapes of the first leg 12 and the second leg 14, an edge 58 of the first leg 12 has a different curvature from an edge 60 of the second leg 14. The edge 58 of the first leg 12 is relatively sharper, while the edge 60 of the second leg 14 is relatively more gently curved than the edge 58 of the first leg 12. The different shaping allows the user to manipulate the styling device 10 to create a variety of stylized looks. This advantage allows the user to create a range of hair styles with a single device that in the past may have required numerous conventional curling irons and/or curling brushes.

Hair strand A, which represents a larger group of hair strands of the type manipulated by a stylist at a time, shows the curl in a first use of the styling device 10. The user positions the unlatched styling device 10 with the second leg 14 pointing towards the scalp 54. The hair strand A is placed between the first and second legs 12, 14, which are then gripped together in the closed position, to achieve the desired amount of braking. Taking the unlatched styling device 10 near the scalp 54, the user pulls the device 10 towards the tip 62 of the hair strand A and away from the scalp 54, rotating the styling device 10 in a clockwise direction towards the head 56.

As the device is moved toward the tip 62, the hair strand A not engaged by the ridges 28, flows through the space 52 between the first leg 12 and the second leg 14. Best results are achieved if the user begins with the device 10 close to the scalp 54. During this operation of the styling device, the hair strand A is being continuously combed by the teeth 25, 27 on the first leg 12 as it flows between the first and second legs 12, 14. This prevents clumping and unnatural crimping of the hair strand A, allowing it to be curled in a natural looking way.

The rotating motion of the device 10 forces the hair strand A against the uppermost rounded edge 60 of the second leg 14, bending the hair strand A. As a result, a small, tight curl 64 that still looks natural and soft is created. Also, by rotating the styling device 10 clockwise, the hair strand A is curled under towards the head 56.

The user may also further manipulate the type of curl created by clamping and releasing the first and second legs 12, 14. As discussed earlier, when the first and second legs 12, 14 are brought together, the ridges 28 act as brakes on the hair strand A, keeping the hair strand A taut as it flows through the space 52. This provides better control of the hair strand A and allows the user to further change the types of curl created.

Hair strand B, the second strand of hair depicted in FIG. 7, depicts another type of curl that can be created by the styling device 10. To create the second look, the user places the hair strand B between the first leg 12 and the second leg 14, keeping the styling device 10 unlatched. As in creating the first look, results are best if the user starts close to the scalp 54. In this method, however, the first leg 12 is located towards the head 56. The user manipulates the styling device 10 in much the same way as done in the first method, pulling the device down towards the tip 62 of the hair strand B, while rotating clockwise towards the head 56. On hair strand B, the device 10 is shown in "normal" (upper) and "rotated" (lower) orientations. Also, the user my further manipulate the curl, as done with hair strand A, by more fully closing the first and second legs 12, 14, causing the ridges 28 to act as brakes on the hair strand B.

This time, however, a much different curl is created than before. The hair strand B is bent over the edge 58 of the first leg 12. Since the edge 58 of the first leg 12 is relatively sharper in shape than the edge 60 of the second leg 14, the curl created is a looser, larger curl. As in the first method, the hair strand B is being continuously combed by the teeth 25, 27 on the first leg 12 as it flows in the space 52 between the two legs 12, 14, which helps keep the curl looking soft and natural.

These two types of curls demonstrate the versatility of the present styling device 10. By merely changing which leg the hair bends against, a user may create curls of different sizes with a single appliance.

The third hair strand depicted, hair strand C, demonstrates another advantage of the styling device 10. Here, instead of using the device 10 to curl the hair, the user is using the device 10 to straighten curly hair. After latching the device 10 in a closed position, the user takes the hair strand C, near the scalp 54 and holds it taut with a free hand. While holding the hair taught, the user rotates the device 10 slightly clockwise and presses the edges 58, 60 of the first and second legs 12, 14 against the hair strand C and rubs the edges 58, 60 along the length of the hair strand C. The edges 58, 60 acts like an iron, effectively straightening the formerly curly hair strand C and illustrating another advantage of the styling device 10. Another advantage is that unlike most styling devices which are made specifically to either straighten or curl the hair, the present device performs both operations. This feature is especially advantageous for a professional stylist who often needs to use straighteners and curlers on customers' hair. With the present device 10, the amount of required styling equipment is significantly reduced.

Hair strand D illustrates another way for the user to straighten curly hair. The user takes the hair strand D, near the scalp and holds it taut with a free hand. While holding the hair taut, the user presses the bottom surface 18 of the first leg 12 against the hair strand D and rubs the bottom surface 18 along the length of the hair strand D. The smoothness of the bottom surface 18 acts like an iron, again effectively straightening the formerly curly hair D. This is another way for the user to straighten curly hair.

Finally, hair strand E depicts another use of the styling device. As in the hair strand B, the user places the hair strand E between the unlatched first and second legs 12, 14, at a point near the scalp 54 with the first leg 12 located near the scalp 54. The user then pulls the styling device 10 down over the length of the hair strand E, this time rotating the styling device 10 counterclockwise. By rotating the styling device 10 counterclockwise, curls 66 are created that turn away from the head 56 in a flip style. While the styling device 10 is being rotated, the hair strand E is being bent over the rounded edge 60 of the second leg 14. As discussed earlier, the hair strand E may be further manipulated by closing the first leg 12 and the second leg 14, so that the ridges 28 act as brakes on the hair.

As in the case of the hair strand A, the edge 60 of the second leg 14 is more rounded than the edge 58 of the first leg 12. This creates a tight, small curl in the direction away from the head 56. Also, as was the case with the unlatched styling device 10 with hair strands A and B, the hair strand E would be continuously combed by the teeth 25, 27 located on the top surface 16 of the first leg 12. This helps to separate the hair strand E and keep it flowing smoothly and naturally between the first leg 12 and the second leg 14.

This latter method can be practiced with the positions of the first and second legs 12, 14 reversed, so that the second leg 14 is located near the scalp 54 (not shown). In that situation, the hair strand E would be forced against the edge 58 of the first leg 12, as was the case with the hair strand B. Like the hair strand B, looser, larger curls would be created by using this method, except this time, the curls would be turned away from the head 56.

Consequently, the present invention provides a styling device that curls or straightens hair in a natural looking way by utilizing a first leg and a second leg. Both the first leg and the second leg have a top surface and a bottom surface, preferably with rows of teeth located between opposing surfaces of the first leg and the second leg. When pressed together in a closed position, the first and second legs are separated by a space which allows most of the hair to flow freely through the styling device. Ridges are also provided between the opposing surfaces to act as brakes on some of the hair to enhance the residence time of the hair in the heated styling end. The teeth on the top side of the second leg have the advantages of a conventional curling brush, e.g., the natural looking curl, separated hair, while the ridges provide more structure to the curl. By heating the first leg and the second leg with separate heating elements, maximum heat conduction to the hair is achieved.

While various embodiments of the present heated hair styling device have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

What is claimed is:

1. A hair styling device comprising:

an elongated first leg having a top surface, a bottom surface, a styling end, and a handle end;

an elongated second leg pivotally secured to said first leg between an open and a closed position, said second leg having a top surface, a bottom surface, a styling end and a handle end;

a plurality of teeth on at least one of said top surface of said first leg and said bottom surface of said second leg;

said respective styling ends of said first and second legs being configured to nest together in said closed position to define a space on said styling end configured such that some of the hair can flow freely through said space as the device is passed through a subject's hair, said space defined by a plurality of ridges, which extend generally transversely to a longitudinal axis of at least one of said first leg and said second leg and come into direct contact with some of the hair as said first and second legs are pressed together, thus providing selective braking of some of the hair as it flows through said space.

2. The hair styling device according to claim 1, wherein said ridges span the entire width of said top surface of said first leg.

3. The hair styling device according to claim 1, wherein said ridges are separated from adjacent said ridges by equal intervals.

4. The hair styling device according to claim 1 wherein said styling end is heat conductive where said teeth are located.

5. The hair styling device according to claim 1, wherein said plurality of teeth on at least one of said first leg and said second leg are arranged in a plurality of rows, said teeth in at least one of said rows being staggered relative to said teeth in an adjacent one of said rows.

6. The hair styling device according to claim 5, wherein said plurality of teeth in at least one of said rows, on at least one of said second leg and said first leg, alternate with at least one of adjacent said teeth between being made of metal and plastic.

7. The hair styling device according to claim 5, wherein said plurality of teeth in at least one of said rows, on at least one of said second leg and said first leg, alternate with at least one of adjacent said teeth in height, so that said plurality of teeth include a plurality of tall teeth and a plurality of short teeth.

8. The hair styling device according to claim 7, wherein said short teeth are made of metal, and said tall teeth are made of plastic.

9. The hair styling device according to claim 5, wherein said plurality of teeth in at least one of said rows, on at least one of said second leg and said first leg, alternate with said teeth in at least one of said rows being made of metal, and said teeth in at least one adjacent row being made of plastic.

10. The hair styling device according to claim 1, wherein said first and second legs are pivotally joined at said handle end, and are biased toward said open position.

11. The hair styling device according to claim 1, further including a latching mechanism for releasably fastening said first and second legs to each other in said closed position.

12. The hair styling device according to claim 1, wherein at least said styling end of said first leg is oval in cross section, defining an arc being part of a circle of radius r1, at least said top of said styling end of said second leg is convex in cross section, and said bottom of at least said styling end of said second leg is concave in cross section, such that said bottom of at least said styling end of said second leg can be nestably engaged with said top of said first leg in said closed position, thereby creating a generally circular shape of a radius R, such that R is less than r1.

13. The hair styling device according to claim 1, wherein said styling end of said first leg further comprises a first edge which is generally sharp, and said styling end of said second leg further comprises a second edge which is generally less sharp than said first edge, such that said first edge creates curls which are round and loose in structure, whereas said second edge creates curls which are tight and more defined in structure than the curls created by said first edge.

14. The hair styling device according to claim 1, wherein each of said styling ends of said first leg and said second leg further comprise a heat insulating piece to allow the user to safely grasp said styling ends of said first leg and said second leg.

15. A heated hair styling device comprising:

an elongated first leg having a top surface, a bottom surface, a styling end, a handle end, and a plurality of teeth on at least one of said top and said bottom surfaces; and an elongated second leg pivotally secured to said first leg between an open and a closed position, said second leg having a top surface, a bottom surface, and a plurality of teeth on at least one of said top and said bottom surfaces, said respective styling ends of said first and second legs being configured to nest together in said closed position to define a space configured such that hair can flow freely through said space as the device is passed through a subject's hair, said space defined by a plurality of ridges, which extend generally transversely to a longitudinal axis of at least one of said first leg and said second leg and come into direct contact with some of the hair as said first and second legs are pressed together, thus providing selective braking of some of the hair as it flows through said space; and a latching element for locking said first leg and said second leg together.

16. A heated hair styling device comprising:

an elongated first leg having a top surface, a bottom surface, a styling end, a handle end, and a plurality of teeth on at least one of said top and said bottom surfaces; and an elongated second leg pivotally secured to said first leg between an open and a closed position, said second leg having a top surface, a bottom surface, and a plurality of teeth on at least one of said top and said bottom surfaces, said respective styling ends of said first and second legs being configured to nest together in said closed position to define a space configured such that hair can flow freely through said space as the device is passed through a subject's hair, said space defined by a plurality of ridges, which extend generally transversely to a longitudinal axis of at least one of said first leg and said second leg and come into direct contact with some of the hair as said first and second legs are pressed together, thus providing selective braking of some of the hair as it flows through said space; and at least one heating element, located in at least one of said first and second legs.

17. The hair styling device according to claim 16, wherein a first heating element is disposed within said first leg, and a second heating element is disposed within said second leg.

* * * * *